US011001428B2

(12) United States Patent
Borg et al.

(10) Patent No.: US 11,001,428 B2
(45) Date of Patent: May 11, 2021

(54) CONTAINER CARRIER WITH FLEXIBLE RAISED HANDLE

(71) Applicant: Oregon Precision Industries, Inc., Eugene, OR (US)

(72) Inventors: Zakary James Borg, Eugene, OR (US); Ronald Lee Mellor, Jr., Eugene, OR (US)

(73) Assignee: OREGON PRECISION INDUSTRIES, INC., Eugene, OR (US)

( * ) Notice: Subject to any disclaimer, the term of this patent is extended or adjusted under 35 U.S.C. 154(b) by 164 days.

(21) Appl. No.: 15/799,670

(22) Filed: Oct. 31, 2017

(65) Prior Publication Data

US 2019/0016515 A1 Jan. 17, 2019

Related U.S. Application Data

(60) Provisional application No. 62/532,923, filed on Jul. 14, 2017.

(51) Int. Cl.
*B65D 71/50* (2006.01)
*B65D 25/28* (2006.01)

(52) U.S. Cl.
CPC ..... *B65D 71/504* (2013.01); *B65D 71/50* (2013.01); *B65D 25/287* (2013.01); *B65D 25/2873* (2013.01)

(58) Field of Classification Search
CPC .. B65D 71/504; B65D 71/50; B65D 25/2873; B65D 25/287

(Continued)

(56) References Cited

U.S. PATENT DOCUMENTS 3,463,536 A * 8/1969 Beyer ..... A47J 45/077 294/31.2
3,949,897 A * 4/1976 Shaw ..... B65D 51/1683 220/231

(Continued)

FOREIGN PATENT DOCUMENTS

EP 1 378 458 A1 1/2004
EP 2028126 A1 2/2009

OTHER PUBLICATIONS

International Bureau of WIPO, International Preliminary Report on Patentability Issued in Application No. PCT/US2018/047389, dated Jan. 14, 2020, WIPO, 13 pages.

(Continued)

*Primary Examiner* — Anthony D Stashick
*Assistant Examiner* — James M Van Buskirk
(74) *Attorney, Agent, or Firm* — Alleman Hall Creasman & Tuttle LLP

(57) ABSTRACT

A container carrier and manufacturing method therefor are provided. The container carrier may include an integrally molded body with a top surface, a bottom surface, and a plurality of annular structures. Each annular structure may connect to at least one adjacent annular structure and may include a circumferential rib with a plurality of flanges, which are collectively configured to secure a container. An integrally formed handle may extend upward from the body of the container carrier. The handle may include a graspable region and a bifurcated region that forms a pair of arms that connect to the body and support the graspable region in an upright configuration in an unbiased state. The arms may flex such that an intersection of the bifurcated region and graspable region moves to accommodate a downward flexion of the handle when a downward biasing force is applied to the handle in a biased state.

14 Claims, 10 Drawing Sheets

(58) Field of Classification Search
USPC ..... 206/145; 220/754, 755, 757, 752; 16/430, 110.1; 150/107; 190/115
See application file for complete search history.

(56) References Cited

U.S. PATENT DOCUMENTS

| | | | | |
|---|---|---|---|---|
| 5,188,413 | A | 2/1993 | Nathan | |
| 7,823,943 | B2 * | 11/2010 | Borg | B65D 71/50 294/87.2 |
| 2004/0134799 | A1 | 7/2004 | Mattson et al. | |
| 2005/0077194 | A1 | 4/2005 | Marco et al. | |
| 2007/0296231 | A1 | 12/2007 | Borg | |

OTHER PUBLICATIONS

Government of the People's Republic of Bangladesh Department of Patents, Designs, and Trademarks, Examination Report Issued in Application No. 313/2018, dated Jan. 7, 2020, 1 page.
Office Action Issued in Application No. IAP20180591/2, dated Apr. 30, 2020, Agency on Intellectual Property Under the Ministry of Justice of the Republic of Uzbekistan, 3 pages.
European Patent Office, Extended European Search Report Issued in Application No. 18812025.7, dated Nov. 13, 2019, Germany, 7 pages.

* cited by examiner

CONTAINER CARRIER WITH FLEXIBLE RAISED HANDLE

This application is a non-provisional of and claims benefit to U.S. Provisional Application Ser. No. 62/532,923, entitled CONTAINER CARRIER WITH FLEXIBLE RAISED STRAP, filed Jul. 14, 2017.

BACKGROUND

Container carriers are used in retail environments to secure a group of containers so that they may be grasped and carried as a single unit. However, the caps of the containers secured within such container carriers may be sharp, posing a potentially uncomfortable situation for a user if the user's skin were to contact a sharp edge of one or more of the caps when attempting to grasp or carry a container carrier. Additionally, the intended grasping location of container carriers may not be intuitive or convenient, which may cause confusion for the user and lead the user to grasp and/or carry the container carrier in an uncomfortable manner in which the weight of the containers is not evenly distributed.

SUMMARY

To address the above issues, a container carrier and manufacturing method for a container carrier are disclosed herein. According to a first aspect, a container carrier for securing together and carrying one or more containers comprising an integrally molded body including a top surface, a bottom surface, and a plurality of annular structures is provided. Each annular structure is connected to at least one adjacent annular structure of the plurality of annular structures by a bridge. Each annular structure has a circumferential rib with a plurality of flanges coupled to the circumferential rib. Each flange includes an inwardly projecting portion. An inner perimeter of each flange is formed to have an arcuate shape, the inner perimeters of the flanges being collectively configured to define a void. An integrally formed handle may extend in an upward orientation from the body of the container carrier. The handle may include a graspable region and a bifurcated region that bifurcates into a pair of arms. Each arm of the pair of arms may connect to the body of the container carrier at a connection point and support the graspable region in an upright configuration in an unbiased state. The pair of arms may flex to allow an intersection of the bifurcated region and graspable region to move, thereby accommodating a downward flexion of the graspable region of the handle when a downward biasing force is applied to the handle in a biased state. Potential advantages of this configuration are that a user can easily and conveniently grasp and carry a container carrier without contacting the potentially sharp edges of the caps of the containers secured within the container carrier, and the handle of the container carrier is configured to flex downward in such a manner that does not interfere with vertical stacking of multiple container carriers.

In this aspect, the handle may be formed to have a graspable region that spans a peak height of the handle in the unbiased state. A potential advantage of this configuration is that a user may intuitively understand to grasp the container carrier at a region that avoids contact with the containers secured therein.

In this aspect, the graspable region may include a substantially flat expanse on a least a lower surface thereof that is configured to be gripped by the fingers of a user. A potential advantage of this configuration is that a user may comfortably grasp and carry the container carrier.

In this aspect, the substantially flat expanse of the graspable region may be solid. A potential advantage of this configuration is that the graspable region may possess increased structural integrity.

In this aspect, the substantially flat expanse of the graspable region may include one or more perforations. A potential advantage of this configuration is that the graspable region may be formed with less material.

In this aspect, the peak height of the handle may be in a range of 1 cm to 10 cm from the top surface of the body of the container carrier, and the handle may be oriented upwardly at a predetermined angle in a range of 15 degrees to 60 degrees relative to the top surface of the body of the container carrier. Potential advantages of this configuration are that a user can readily identify a location to grasp and transport the container carrier, and that a user can avoid contact with the caps of the containers secured within the container carrier, which may possess sharp edges.

In this aspect, a first arm of the bifurcated region may connect at a first connection point to a first bridge of the body, and a second arm of the bifurcated region may connect at a second connection point to a second bridge of the body. A potential advantage of this configuration is that the weight of the containers secured within the container carrier is distributed between multiple connection points on the body of the carrier to increase the structural integrity of the container carrier.

In this aspect, the peak height of the handle may be positioned at a central location with respect to the body of the container carrier. A potential advantage of this configuration is that the location at which a user grasps the container carrier is central to the body of the container carrier such that the weight of the containers is evenly distributed to increase the stability of the container carrier and provide a balanced load for the user.

In this aspect, a shape of a curve of the handle may be concave down when the handle is in an upright position, and the shape of the curve of the handle may be concave up when the handle is in a deflected position. A potential advantage of this configuration is that the handle provides a readily accessible grasping location for a user when the top of the container carrier is unobstructed, and the handle can deflect below the surface of the body of the container carrier when a force applied by a hand, packing surface, or other object is applied to the top of the container carrier so that the handle does not interfere with the ability to arrange a plurality of container carriers in a vertically stacked configuration.

In this aspect, each arm of the pair of arms may include a straight portion and a curved portion. A potential advantage of this configuration is that the arms may flex when a force is applied, thereby permitting the shape of the handle to distort while remaining anchored to the body of the container carrier.

In this aspect, the flanges of each annular structure may be configured to flex independently during ingress or egress of one of the containers into or out of the corresponding void, and, in an unflexed state, the flanges may collectively conform to a curvature of a neck of one of the containers to releasably engage the container, the neck being smaller than a lip or a cap of the container. A potential advantage of this configuration is that the container carrier is configured to accommodate caps that are of different shapes or larger sizes than the necks of the corresponding containers that are to be secured therein.

In this aspect, each inwardly projecting portion may extend inwardly from the circumferential rib, and all of the inwardly projecting portions may be oriented upwardly at a predetermined angle from the circumferential rib. A potential advantage of this configuration is that the inwardly projecting portions are collectively configured to releasably engage a container at its neck and distribute the weight of the container across the plurality of inwardly projecting portions.

In this aspect, the bifurcated region may be a first bifurcated region that bifurcates into a first pair of arms, the first bifurcated region being coupled to a first side of the graspable region at a first intersection. The handle may further include a second bifurcated region coupled to a second side of the graspable region at a second intersection positioned opposite the first intersection of the graspable region. The second bifurcated region may bifurcate into a second pair of arms, and each arm of the second pair of arms may connect to the body of the container carrier at a connection point and support the graspable region in an upright configuration in an unbiased state. The second pair of arms may flex to allow a second intersection of the bifurcated region and graspable region to move, thereby accommodating a downward flexion of the graspable region of the handle when a downward biasing force is applied to the handle in a biased state. Potential advantages of this configuration are that the weight of the containers secured within the container carrier is distributed across the body of the carrier to provide a balanced load for the user, and the handle of the container carrier is configured to flex downward in such a manner that does not interfere with vertical stacking of multiple container carriers.

In this aspect, flexing of the first and second pairs of arms may cause the first and second intersections, respectively positioned at the first and second sides of the graspable region, to move away from each other, thereby increasing a distance between the first and second bifurcated regions to accommodate passage of the graspable region between the first and second bifurcated regions as viewed from above, and through a plane of the body, as viewed from a side. A potential advantage of this configuration is that the graspable region is flanked by bifurcated regions, the arms of which can deform to allow the handle to move to a position at or below a plane of the body of the container carrier.

In another aspect, a manufacturing method for a container carrier for securing together and carrying one or more containers is provided. The method includes molding an integrally formed body including a top surface, a bottom surface, and a plurality of annular structures. The method further includes forming each annular structure to be connected to at least one adjacent annular structure of the plurality of annular structures by a bridge. The method further includes forming each annular structure have a circumferential rib with a plurality of flanges coupled to the circumferential rib, each flange including an inwardly projecting portion. The method further includes forming an inner perimeter of each flange to have an arcuate shape, the inner perimeters of the flanges being collectively configured to define a void. The method further includes molding an integrally formed handle that extends in an upward orientation from the body of the container carrier. The method further includes forming the handle to include a graspable region and a bifurcated region that bifurcates into a pair of arms. The method further includes forming each arm of the pair of arms to connect to the body of the container carrier at a connection point and support the graspable region in an upright configuration in an unbiased state. The method further includes forming the pair of arms to flex to allow an intersection of the bifurcated region and graspable region to move, thereby accommodating a downward flexion of the graspable region of the handle when a downward biasing force is applied to the handle in a biased state. Potential advantages of this configuration are that a user can easily and conveniently grasp and carry a container carrier without contacting the potentially sharp edges of the caps of the containers secured within the container carrier, and the handles of the container carriers are configured to flex downward in such a manner that does not interfere with vertical stacking of multiple container carriers.

DETAILED DESCRIPTION

Selected embodiments of the present disclosure will now be described with reference to the accompanying drawings. It will be apparent to those skilled in the art from this disclosure that the following descriptions of the embodiments of the disclosure are provided for illustration only and not for the purpose of limiting the disclosure as defined by the appended claims and their equivalents.

First Embodiment

Figure 1:
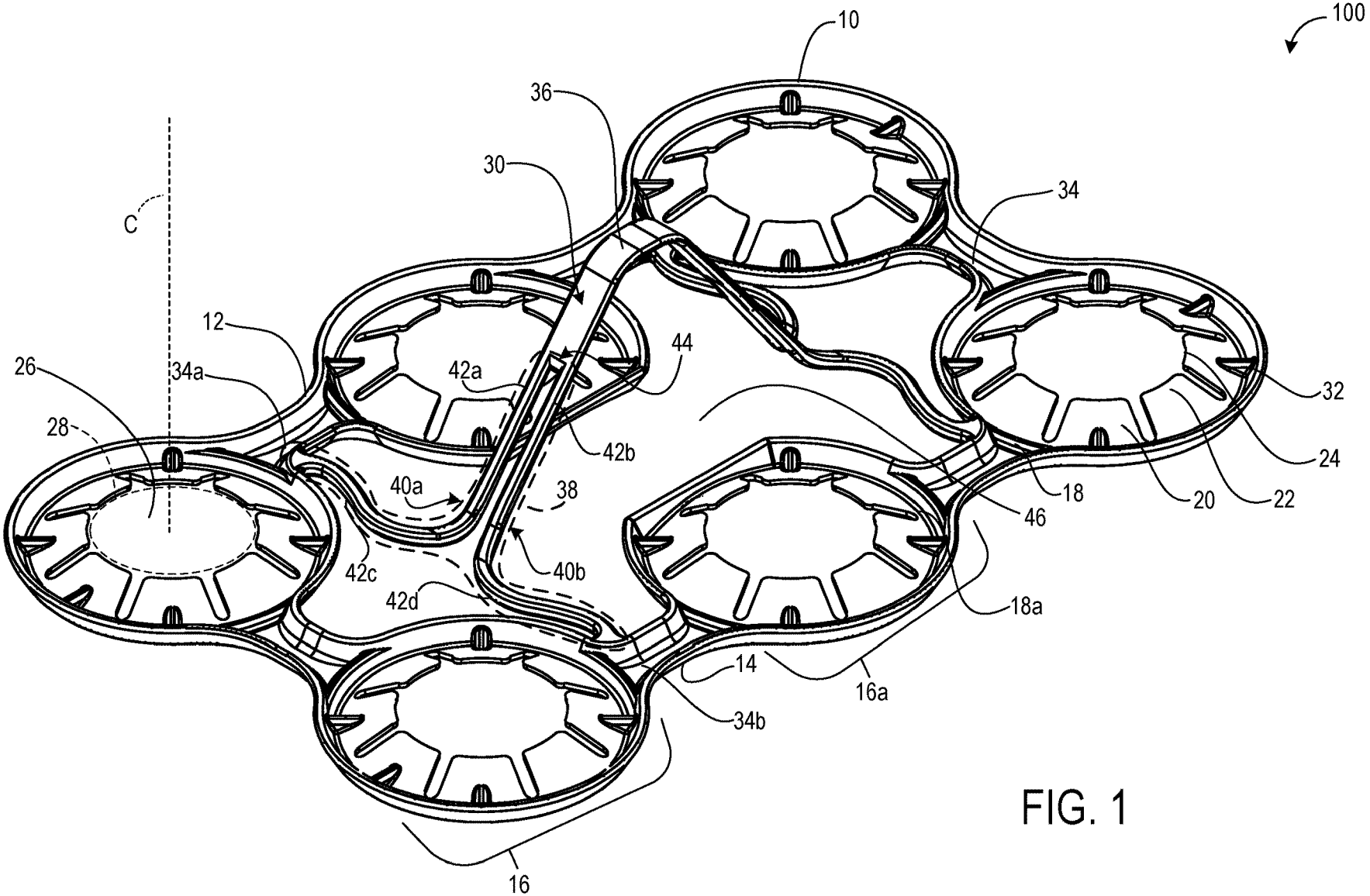
FIG. 1 shows a top perspective view of a container carrier according to one embodiment of the present description.

Turning to the figures, FIG. 1 illustrates one embodiment of a container carrier 100 configured to secure together and carry one or more containers at one time. The body 10 of the container carrier 100 may be integrally molded and may include at least a top surface 12, a bottom surface 14, and a plurality of annular structures 16. In the present embodiment, the body 10 of the container carrier 100 is preferentially formed by injection molding; however, it will be appreciated that another suitable molding technique may be employed to form the body 10 of the container carrier 100.

Each annular structure 16 may be connected to at least one adjacent annular structure 16 of the plurality of annular structures 16 by a bridge 34 and may include a circumferential rib 18. A plurality of flanges 20 may be coupled to the circumferential rib 18. Each flange 20 may further include an inwardly projecting portion 22. In the present embodiment, eight flanges 20 are provided in each annular structure 16, but it will be appreciated that the number of flanges 20 in the annular structures 16 may be more or less than illustrated, so long as their shape and position are sufficient to releasably secure a container.

An inner perimeter 24 of each flange 20 may be formed to have an arcuate shape. Collectively, the inner perimeters 24 of the flanges 20 may be configured to define a void 26. Further, the void 26 defined by the arcuate inner perimeters 24 of the flanges may be formed to have a circular perimeter 28. The circular perimeter 28 of the void 26 may be centered on a vertical central axis C of the annular structure 16. A container may be inserted into void 26, and the flanges 20 may collectively secure the container therein.

An integrally formed handle 30 may extend in an upward orientation from the body 10 of the container carrier 100. A shape of the curve of the handle 30 may be concave down when the handle is in an upright configuration in an unbiased state, and the shape of the curve of the handle may be concave up when the handle is in a deflected configuration in a biased state.

Figure 5:
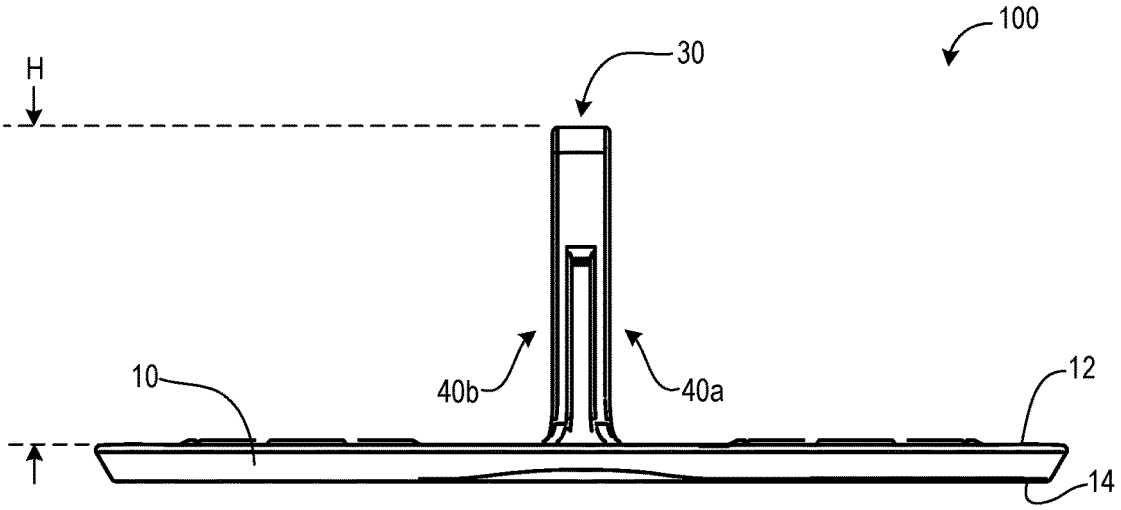
FIG. 5 shows a front view of the container carrier of FIG. 1, wherein the back view is an identical image thereof.

As shown in FIG. 1 with reference to FIG. 5, the handle 30 may be formed to have a graspable region 36 that spans a peak height H of the handle 30 in an unbiased state and supports the lifting force of a finger or fingers of a user to provide a secure and comfortable structure by which a user may grasp the container carrier 100. The graspable region 36 may further include a substantially flat expanse on a least a lower surface thereof that is configured to be gripped by the fingers of a user. The substantially flat expanse of the graspable region 36 is typically a solid region without holes or gaps provided therein. In an alternative embodiment, the substantially flat expanse of the graspable region 36 may include one or more internal perforations or holes.

As shown in the illustrated embodiment, the handle 30 may be formed to further include a bifurcated region 38, enclosed in dashed lines in FIG. 1, that may bifurcate into a pair of arms separated by a gap. Each arm 40*a*, 40*b* of the pair of arms may connect to the body 10 of the container carrier 100 at a connection point to support the graspable region 36 in an upright configuration in the unbiased state. In one implementation, a first arm 40*a* of the bifurcated region 38 may connect at a first connection point to a first bridge 34*a* of the body, and a second arm 40*b* of the bifurcated region 38 may connect at a second connection point to a second bridge 34*b* of the body 10. However, it will be appreciated that the arms 40*a*, 40*b* may also connect to the same bridge 34.

The arms 40*a*, 40*b* may be formed to include respective straight regions 42*a*, 42*b* and respective curved regions 42*c*, 42*d*. The straight regions 42*a*, 42*b* are positioned adjacent an intersection 44 of the bifurcated region 38 and the graspable region 36. As the arms 40*a*, 40*b* approach a horizontal plane in which the top surface 12 of the container carrier 100 is arranged, the straight regions 42*a*, 42*b* may flare out into respective curved regions 42*c*, 42*d* before connecting to the body 10 of the container carrier 100. This configuration allows the arms 40*a*, 40*b* to flex when a force is applied, which permits the shape of the handle 30 to distort while remaining anchored to the body 10 of the container carrier 100. Specifically, when a downward biasing force is applied to the handle 30 in a biased state, the pair of arms 40*a*, 40*b* flexes to allow the intersection 44 between the bifurcated region 38 and graspable region 36 to move such that a downward flexion of the graspable region 36 of the handle 30 can be accommodated. For example, when an item pushes down on or is stacked on top of a container carrier 100, the straight regions 42*a*, 42*b* of the pair of arms 40*a*, 40*b* flex away from the graspable region 36, as indicated by the dashed lines in FIG. 3, as the handle 30 transitions to a deflected configuration in a biased state.

The above-described bifurcated region 38 and arms 40*a*, 40*b* may be designated as a first bifurcated region 38*a* and a first pair of arms 40*a*, 40*b*, and the handle 30 may further include a second bifurcated region 38*b* that bifurcates into a second pair of arms 40*c*, 40*d*. As illustrated by the dash-dot line in FIG. 4, the first bifurcated region 38*a* may be coupled to a first side of the graspable region 36 at a first intersection 44*a*. Accordingly, the second bifurcated region 38*b* may be coupled to a second side of the graspable region 36 at a second intersection 44*b* positioned opposite the first intersection 44*a* of the graspable region 36. Like the first pair of arms 40*a*, 40*b*, each arm of the second pair of arms 40*c*, 40*d* may connect to the body 10 of the container carrier 100 at a respective connection point and support the graspable region 36 in an upright configuration in an unbiased state.

The first and second pairs of arms 40*a*, 40*b*, 40*c*, 40*d* may flex to allow the respective first and second intersections 44*a*, 44*b* to move, thereby accommodating a downward flexion of the graspable region 36 of the handle 30 when a downward biasing force is applied to the handle 30 in a biased state. Such flexing of the first and second pairs of arms 40*a*, 40*b*, 40*c*, 40*d* causes the first and second intersections 44*a*, 44*b* to move away from each other, thereby increasing a distance D between the first and second bifurcated regions 38*a*, 38*b* to accommodate passage of the graspable region 36 between the first and second bifurcated regions 38*a*, 38*b* as viewed from above, and through a plane P of the body 10, as viewed from a side. One embodiment of the handle 30 in a deflected configuration after passage of the graspable region 36 through the plane P of the body 10 is illustrated by the dash-dot line in FIG. 6.

Figure 7:
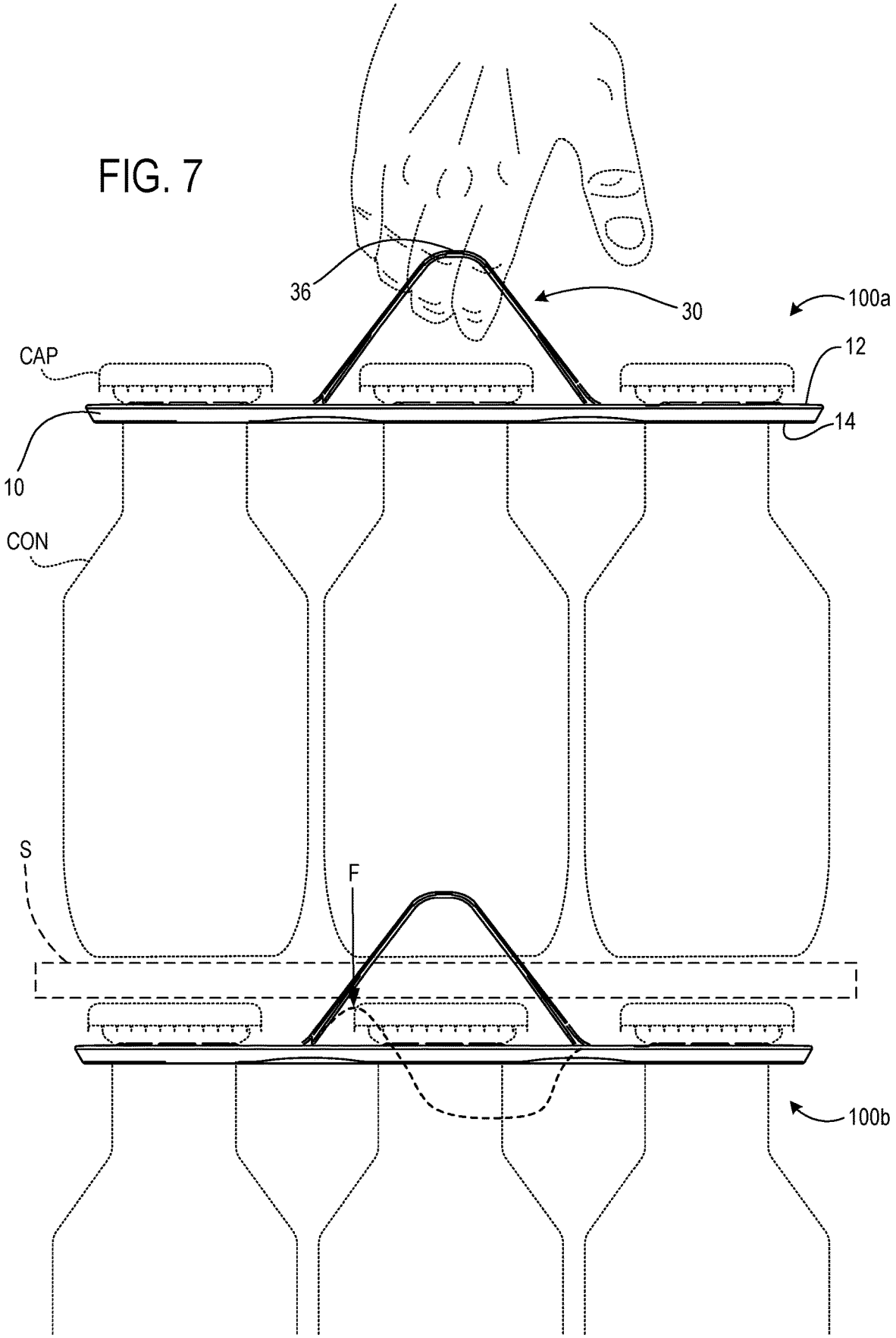
FIG. 7 shows a side view of two container carriers of FIG. 1 in a stacked configuration.

Turning now to FIG. 7, a side view of one embodiment of two container carriers 100*a*, 100*b* in a stacked configuration is shown. As described above, the handle 30 of the respective upper container carrier 100*a* is in an upright position in an unbiased state, and the shape of the curve of the handle 30 is concave down. In this configuration, the graspable region 36 of the handle 30 extends above the top surface 12 of the body 10 of the container carrier 100*a* to provide a structure that is intuitive for a user to grasp. The height of the handle 30 is configured to allow the user to grasp and carry the container carrier 100*a* without contacting the caps CAP of the containers CON secured within the container carrier 100*a*, thereby avoiding a potential injury that may be sustained if the caps CAP of the containers CON possess any sharp edges. It will be appreciated that, in its native state, i.e., when no force is being applied, the container carrier 100 assumes a configuration in which the handle 30 is in an upright position in an unbiased state.

FIG. 7 illustrates the ability of the handle 30 to flex downward below the bottom surface 14 of the body 10 of the container carrier 100 when a force is applied from above. As discussed above, the arms 40*a*, 40*b* support the graspable region in an upright configuration in the unbiased state. When a downward biasing force F is applied to the handle in a biased state, the pair of arms may flex to allow an intersection of the bifurcated region and graspable region to move. Such movement may accommodate a downward flexion of the graspable region of the handle. For example, it may be desirable to arrange containers CON and their respective container carriers 100 in a stacked configuration for storage or marketing purposes. To achieve this arrangement, a user may place a structure S, such as corrugated cardboard or a board, on top of a first level of container carriers 100 to provide a flat surface for stacking the next level of container carriers 100. In such a configuration, the handle 30 of the respective lower container carrier 100*b* deflects to a position that is at least partially below the bottom surface 14 of the body 10 of the container carrier 100*b*, as illustrated by the dashed line in FIG. 7 that represents the handle 30 in a deflected position in a biased state in which the shape of the curve of the handle 30 is concave up. In the deflected position, the handle 30 does not interfere with a user's ability to arrange containers CON within which respective container carriers 100 are packed in a vertically stacked configuration.

To releasably engage the containers CON in the container carrier 100, the flanges 20 included in each annular structure 16 may be configured to flex independently during ingress or egress of one of the containers CON into or out of the corresponding void 26. In an unflexed state, the flanges 20 may be collectively configured to conform to a curvature of a neck of one of the containers CON. The flanges 20 are thus configured to releasably engage a container CON at the neck, the outer diameter of the neck being smaller than an inner diameter of a lip or a cap CAP of the container CON, as illustrated in FIG. 7.

Turning back to FIG. 1, one or more of the plurality of flanges 20 of each annular structure 16 may be provided with a support rib 32. The support rib 32 may bridge the flange 20 and the circumferential rib 18 of the corresponding annular structure 16 to increase strength and stability of the container carrier 100. Support ribs 32 add dimensional support to the annular structures 16 by coupling the circumferential ribs 18 and flanges 20. It will be appreciated that support ribs 32 may be included on or absent from any number of the flanges 20 and that the illustrated embodiment provides only one example of myriad possibilities in which the support ribs 32 may be arranged on the flanges 20, such as centered or offset. One or more support ribs 32 may also be arranged between flanges 20 at the point of connection to the circumferential rib 18. Additionally, the thickness and shape of the support ribs 32 may vary depending on the size, shape, and/or weight of container and/or its corresponding cap. For example, the support ribs 32 on a container carrier 100 designed to carry heavier containers may be more numerous, thicker, and/or longer than support ribs 32 on a container carrier 100 that is intended for relatively lighter containers.

Figure 2:
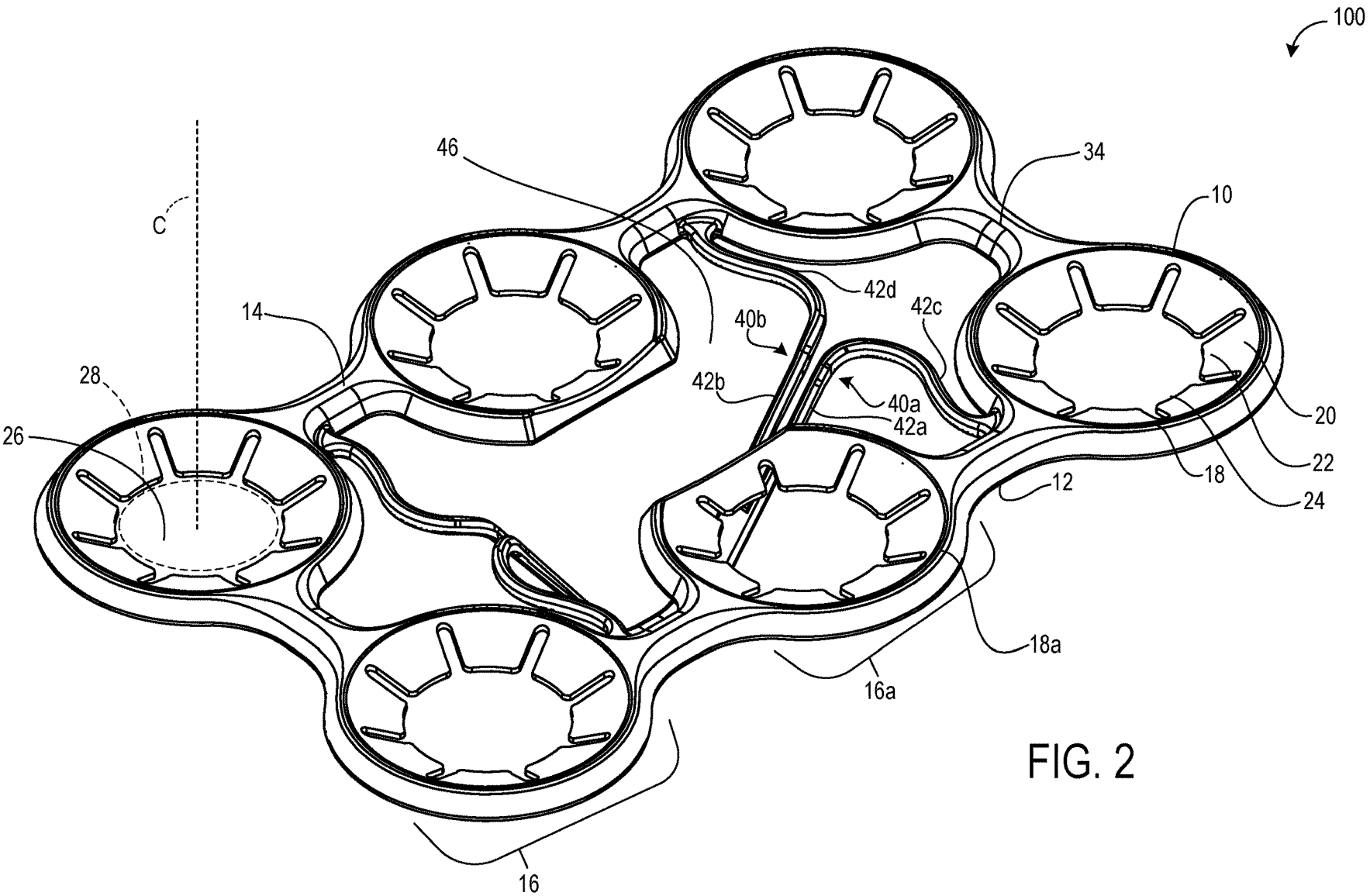
FIG. 2 shows a bottom perspective view of the container carrier of FIG. 1.

Turning to FIG. 2, a bottom perspective of the container carrier 100 is shown. In the illustrated example, the circumferential rib 18 of the container carrier 100 is present but thinner on the bottom surface 14 of the container carrier 100. It will be appreciated that, in other embodiments, the circumferential rib 18 may be thicker on the bottom surface 14 as compared to the top surface 12, or of equal thickness on both the top and bottom surfaces 12, 14 of the container carrier 100. Further, while the support ribs 32 are absent on the bottom surface 14 of the container carrier 100 in the illustrated embodiment, it will be appreciated that support ribs 32 may formed on either or both of the top and bottom surfaces 12, 14 of the container carrier 100.

Figure 3:
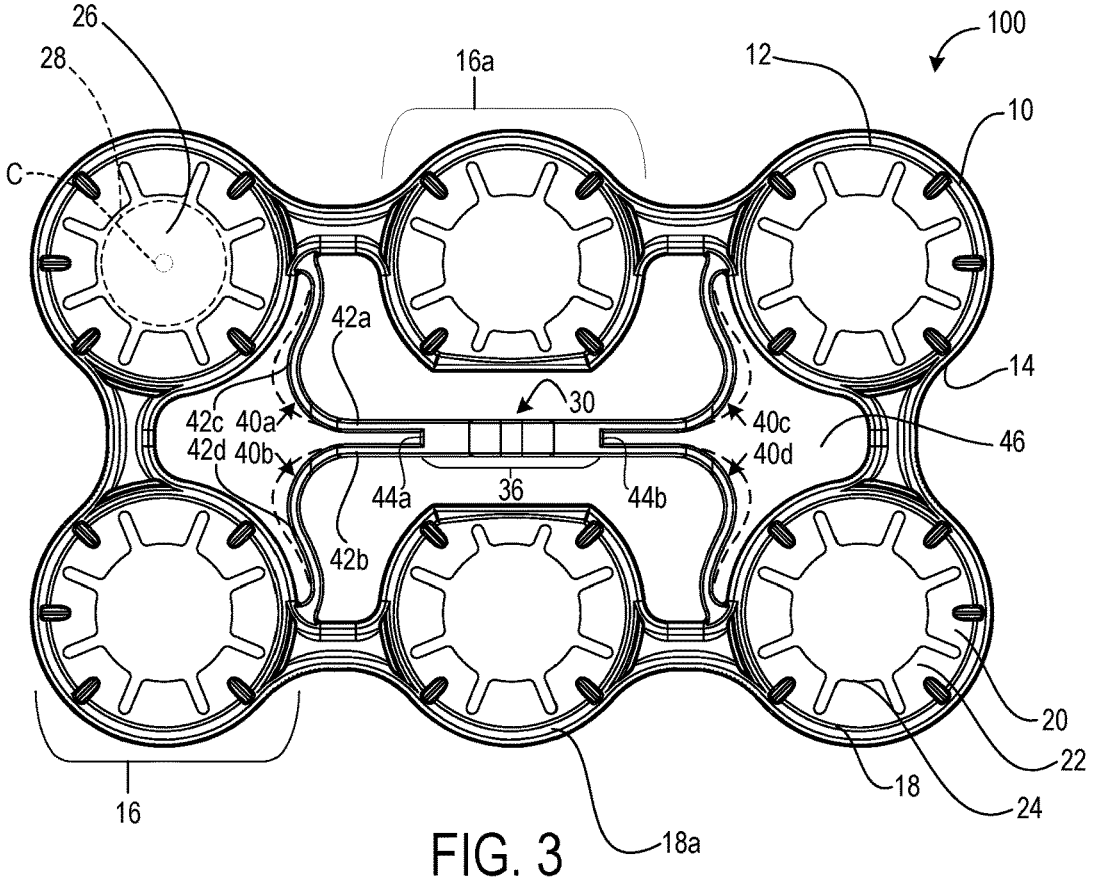
FIG. 3 shows a top view of the container carrier of FIG. 1.
Figure 4:
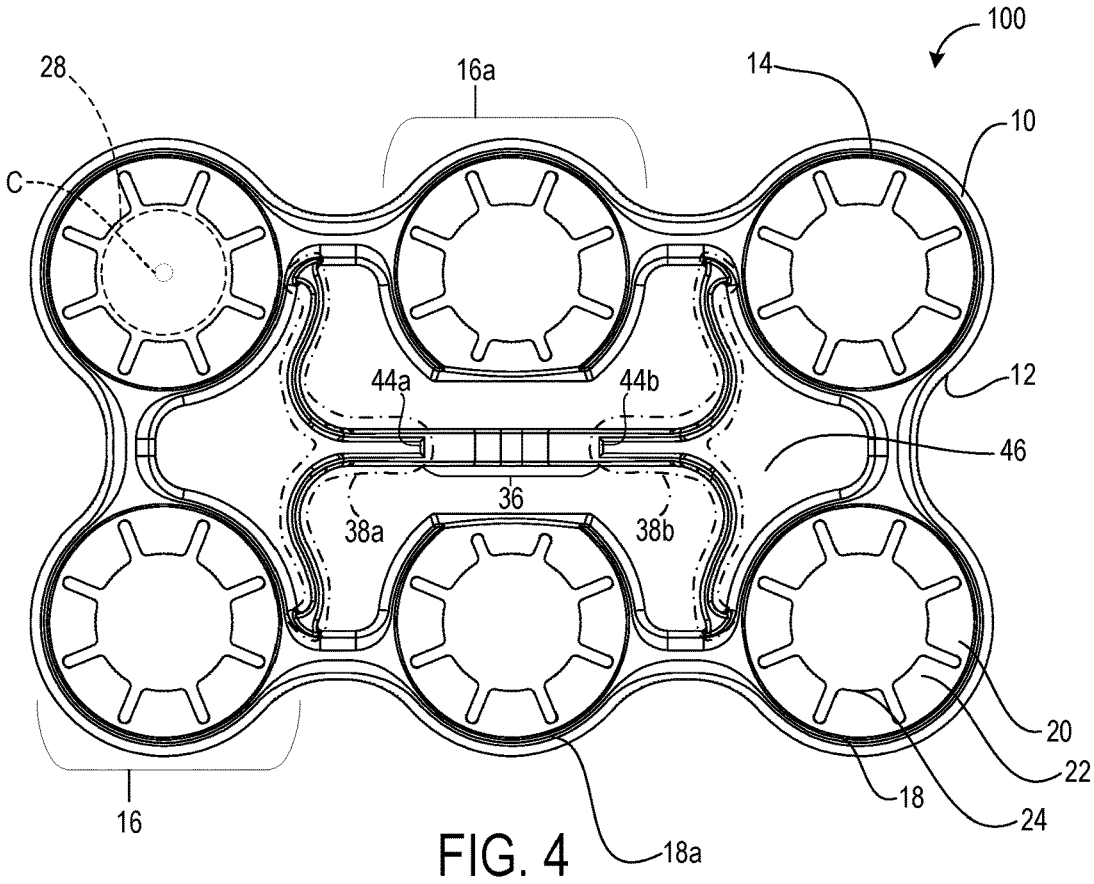
FIG. 4 shows a bottom view of the container carrier of FIG. 1.

Continuing now to FIGS. 3 and 4, top and bottom views of the container carrier 100 are provided. As discussed above, the flanges 20 may be attached to a circumferential rib 18 of an annular structure 16 while the inner perimeters 24 of the inwardly projecting portions 22 of the flanges 20 may collectively define a void 26 with a circular perimeter 28. As shown, the container carrier 100 may include one or more container-engaging structures 16*a* that are not annular. It will be appreciated that, like the annular structure 16, a semi-annular container-engaging structure 16*a* may include flanges 20 attached to a circumferential rib 18*a*. In the illustrated configuration, four annular structures 16 and two semi-annular structures 16*a* with annular inner perimeters and truncated outer perimeters are shown. However, it will be appreciated that the presence, quantity, and arrangement of annular and semi-annular container-engaging structures 16, 16*a* may vary in other implementations of the container carrier 100 that are not illustrated herein.

The container-engaging semi-annular structure 16*a* may be formed to have a semi-annular shape by including a straight portion in the circumferential rib 18*a* that is positioned toward an interior void 46 of the body 10 of the container carrier 100. This implementation increases the area of the interior void 46 of the container carrier 100 to provide room for the flexion of the handle 30 as it transitions from an upright position to a deflected position. As discussed above and illustrated in the present embodiment, the circular perimeter 28 of the void 26 may be centered on a vertical central axis C of the annular structure 16 or the container-engaging semi-annular structure 16*a*. However, it will be appreciated that the circular perimeter 28 of the void 26 may be offset with respect to the annular structure 16 or the container-engaging semi-annular structure 16*a*.

The arrangement of the flanges 20 defining a circular perimeter 28 of a void 26 within an annular structure 16 may give rise to a configuration in which the plurality of flanges 20 may have the same lengths. This configuration may be observed in an embodiment of a container carrier 100 in which the annular structure 16 and the circular perimeter 28 of the void 26 are both centered on central vertical axis C. As described above, the container carrier 100 may include one or more container-engaging structures 16*a* that may be formed to have a semi-annular shape. In this alternate configuration, one or more of the flanges 20 positioned proximate the straight region of the circumferential rib 18*a* of the container-engaging semi-annular structure 16*a* may be formed to be shorter than adjacent flanges 20. However, it will be appreciated that the inner perimeters 24 of the flanges 20 may collectively define a void 26 with a circular perimeter 28, regardless of the shape of the container-engaging structure. While the illustrated embodiment includes an even number of flanges 20, with the annular structure 16 and the circular perimeter 28 of the void 26 both centered on the central vertical axis C, it will be appreciated that the configuration of the container carrier 100 is not limited to illustrated embodiment. For example, the flanges 20 may occur in an even or an odd number and may be formed to be equal in length to, or longer or shorter than an adjacent flange 20 to accommodate a desired container size/weight and/or a desired cap size/shape. Further, as discussed above, the circular perimeter 28 of the void 26 may be offset with respect to the annular structure 16 or the container-engaging semi-annular structure 16*a*.

Figure 6:
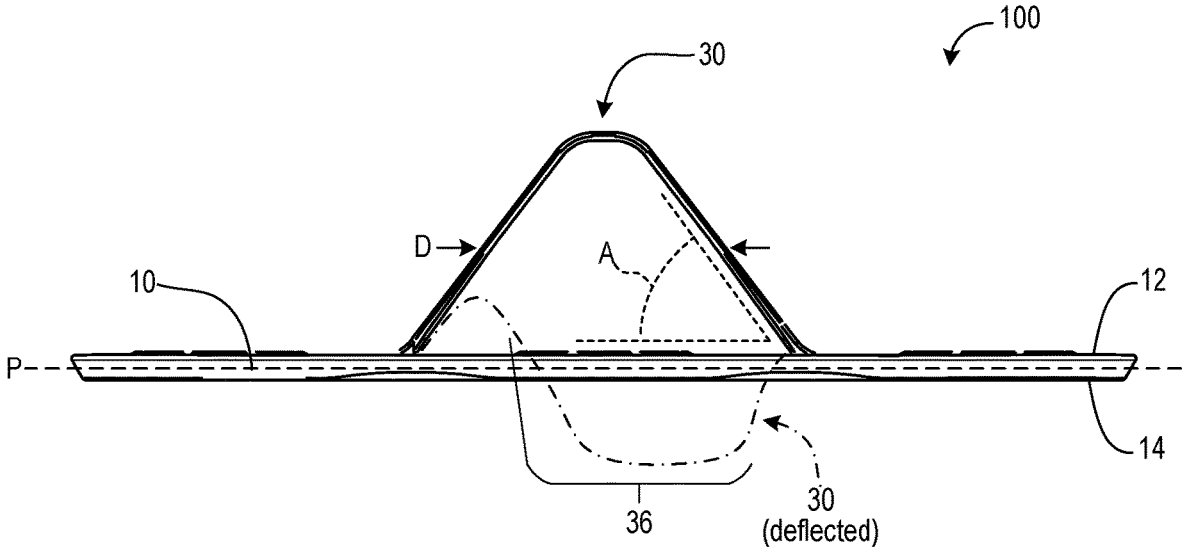
FIG. 6 shows a right side view of the container carrier of FIG. 1, wherein the left side view is an identical image thereof.

Turning now to FIGS. 5 and 6, front and side views, respectively, of the container carrier 100 are illustrated. As shown, the peak height H of the handle 30 may be in a range of 1 cm to 10 cm from the top surface 12 of the body 10 of the container carrier 100. With reference to FIG. 1, the peak height H of the handle 30 may be positioned at a central location with respect to the body 10 of the container carrier 100. The handle 30 may be oriented upwardly at a predetermined angle A in a range of 15 degrees to 60 degrees relative to the top surface 12 of the body 10 of the container carrier 100.

As shown in FIGS. 5 and 6 and with reference to FIG. 1, each flange 20 may include an inwardly projecting portion 22. Each inwardly projecting portion 22 may extend inwardly from the circumferential rib 18, and all of the inwardly projecting portions 22 may be oriented upwardly from the circumferential rib 18. The angle of upward orientation of the inwardly projecting portions may be in a range from 15 to 60 degrees, in one example. Depending on the size or shape of a container neck and cap, as well as the weight of the contents of a container, the angle of upward orientation may be customized to provide the necessary stiffness or flexibility to accommodate a desired container.

As illustrated in FIGS. 5 and 6, the integrally molded body 10 of the container carrier 100 may be formed to be substantially planar. The dashed line P in FIG. 6 indicates the horizontal plane of the body 10 of the container carrier 100. Preferably, the substantially planar body 10 of the container carrier 100 may be between 5 and 25 millimeters thick in a vertical direction. The planar configuration of the container carrier 100 coupled with the upward orientation of the inwardly projection portions 22 allows multiple like-shaped container carriers 100 to nest inside one another when stacked. This feature increases the efficiency of packaging and shipping the container carriers 100, and also allows for multiple container carriers 100 to be loaded into a mechanical applicator for applying to containers. Further, when a container carrier 100 releasably engages containers, the product and its labels are not obscured thereby providing maximum product and label visibility. If desired, the planar body of a container carrier 100 may allow for placement of a bar code or price tag, further increasing the aesthetic value of the product contained therein.

Second Embodiment

Looking now at FIGS. 8-13, a second embodiment of a container carrier 200 is illustrated. Since the container carrier 200 of the second embodiment is generally similar to that of a container carrier 100 of the first embodiment lacking the curved regions 42*c*, 42*d* of the handle 30 and the semi-annular container-engaging structures 16*a*, the detailed description thereof is abbreviated for the sake of brevity. It is to be noted that like parts are designated by like reference numerals throughout the detailed description and the accompanying drawings.

Figure 8:
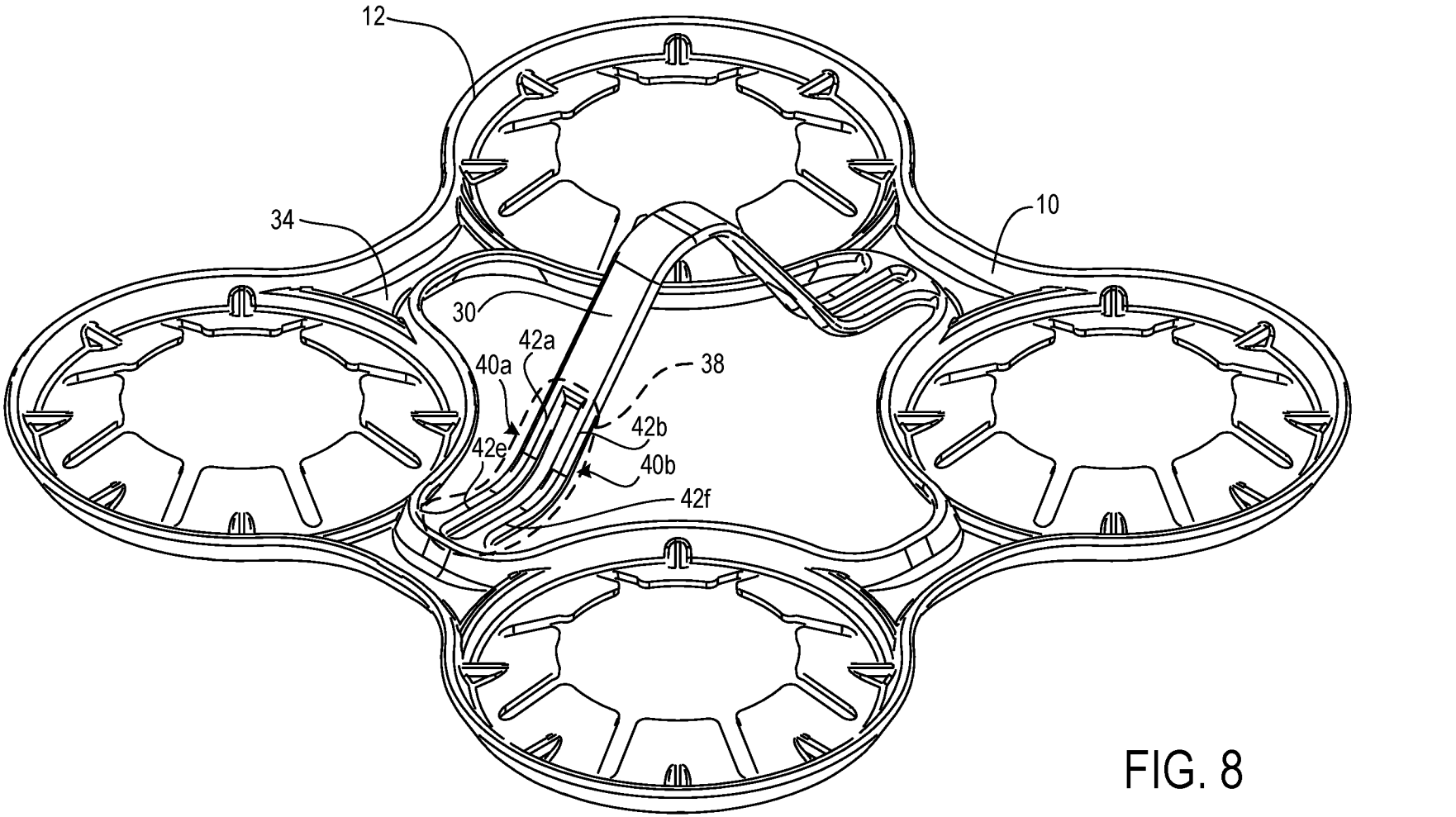
FIG. 8 shows a top perspective view of a container carrier according to a second embodiment of the present description.
Figure 9:
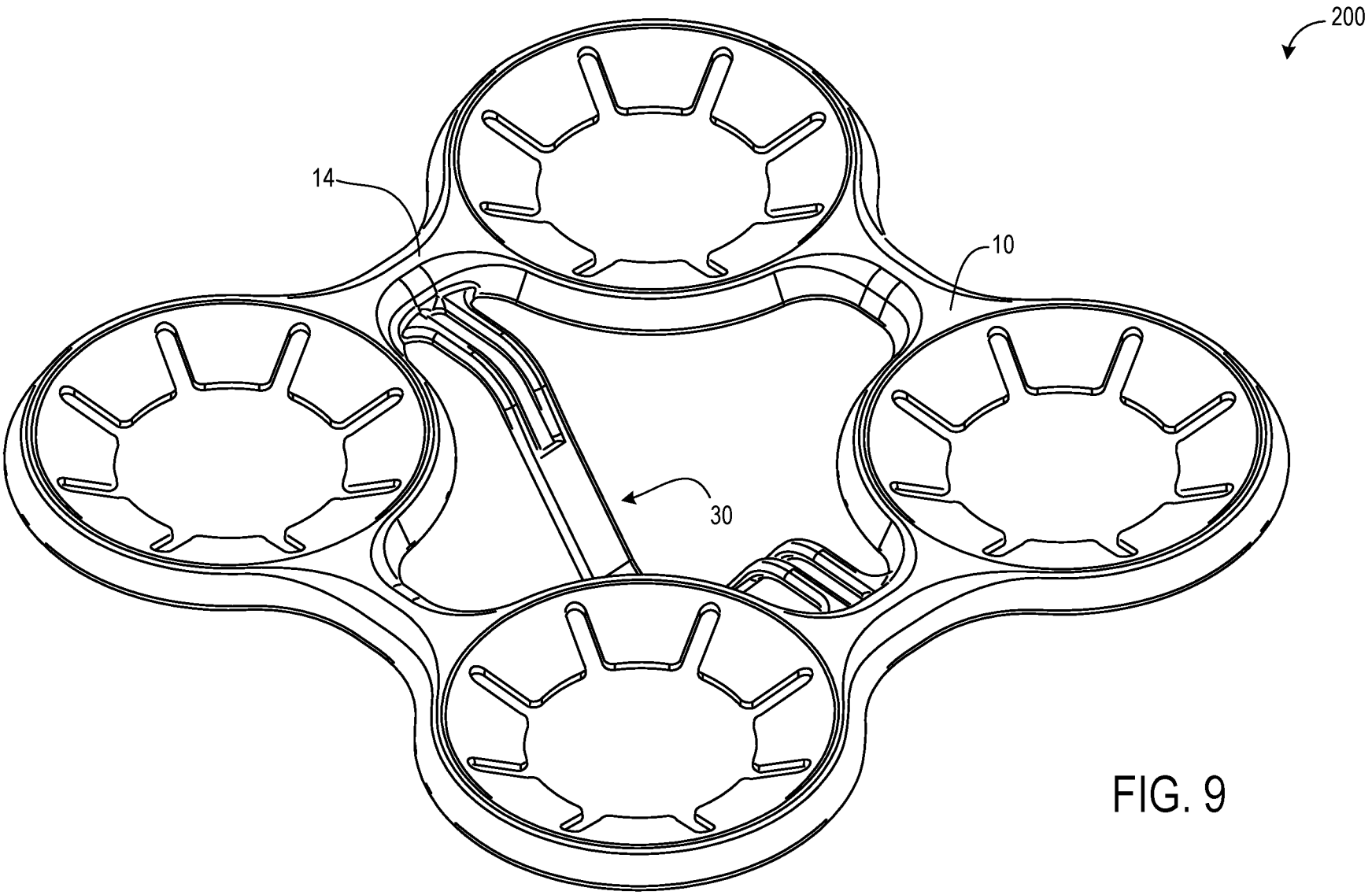
FIG. 9 shows a bottom perspective view of the container carrier of FIG. 8.
Figure 10:
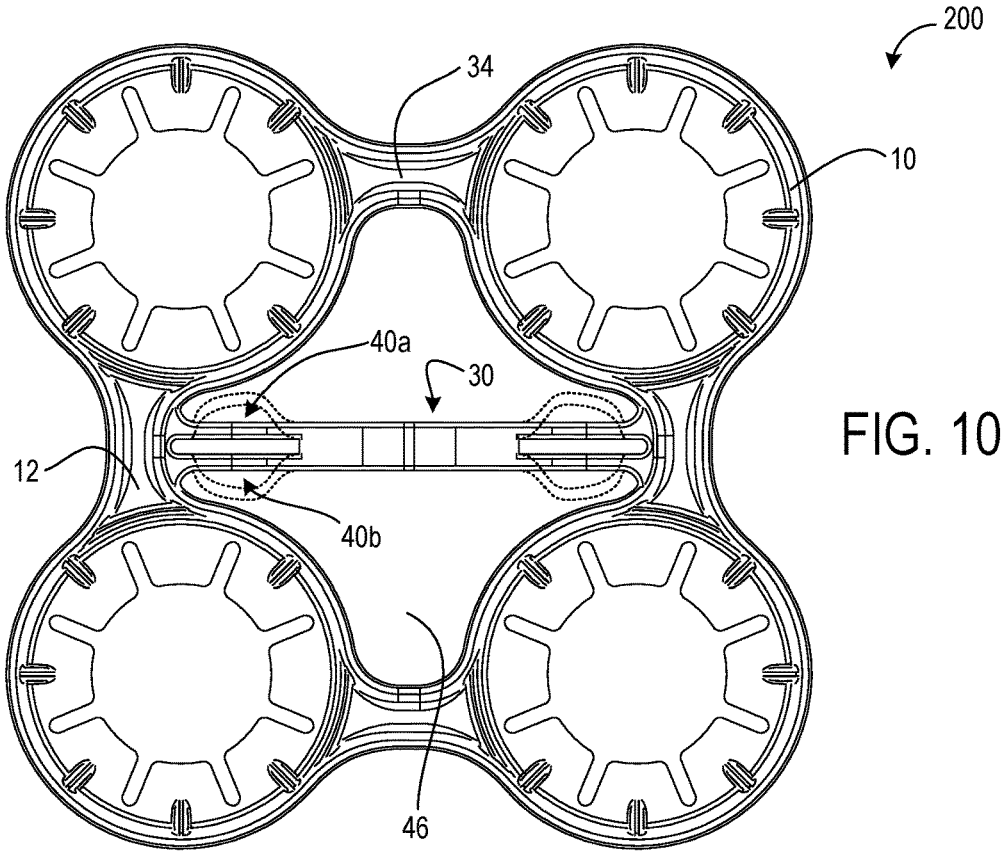
FIG. 10 shows a top view of the container carrier of FIG. 8.

FIGS. 8 and 9 illustrate top and bottom perspective views, respectively, of the second embodiment of the container carrier 200. As described above and shown in FIG. 8 with reference to FIG. 10, the bifurcated region 38 in the handle 30 separates the end of the handle 30 into two flexible arms 40*a*, 40*b*. The arms 40*a*, 40*b* are formed to have respective straight regions 42*a*, 42*b* along the portion of the handle 30 similar to those of the first embodiment of the container carrier 100. However, as the arms 40*a*, 40*b* approach a horizontal plane in which the top surface 12 of the container carrier 200 is arranged, they may curve to transition to regions 42*e*, 42*f* that remain in the same vertical plane as the handle 30 but become horizontally planar with respect to the body 10 of the container carrier 200. As described above with respect to the first embodiment of the container carrier 100, the arms 40*a*, 40*b* may connect to the body 10 of the container carrier 200 at two connection points. In the second embodiment, the arms 40*a*, 40*b* may connect to the body 10 of the container carrier 200 at two connection points on the same bridge 34, as illustrated in FIGS. 8 and 10, rather than two connection points on two separate bridges as described in the first embodiment and shown in FIGS. 1 and 3. Similar to the first embodiment, when a force is applied from above, such as stacking another container carrier 200 on top of a first container carrier 200, the gap of the bifurcated region 38 allows the straight regions 42*e*, 42*f* of the second embodiment to flex apart from one another as the handle 30 is transitioning from an upright position to a deflected position, as indicated by the dashed lines in FIG. 10.

Figure 14:
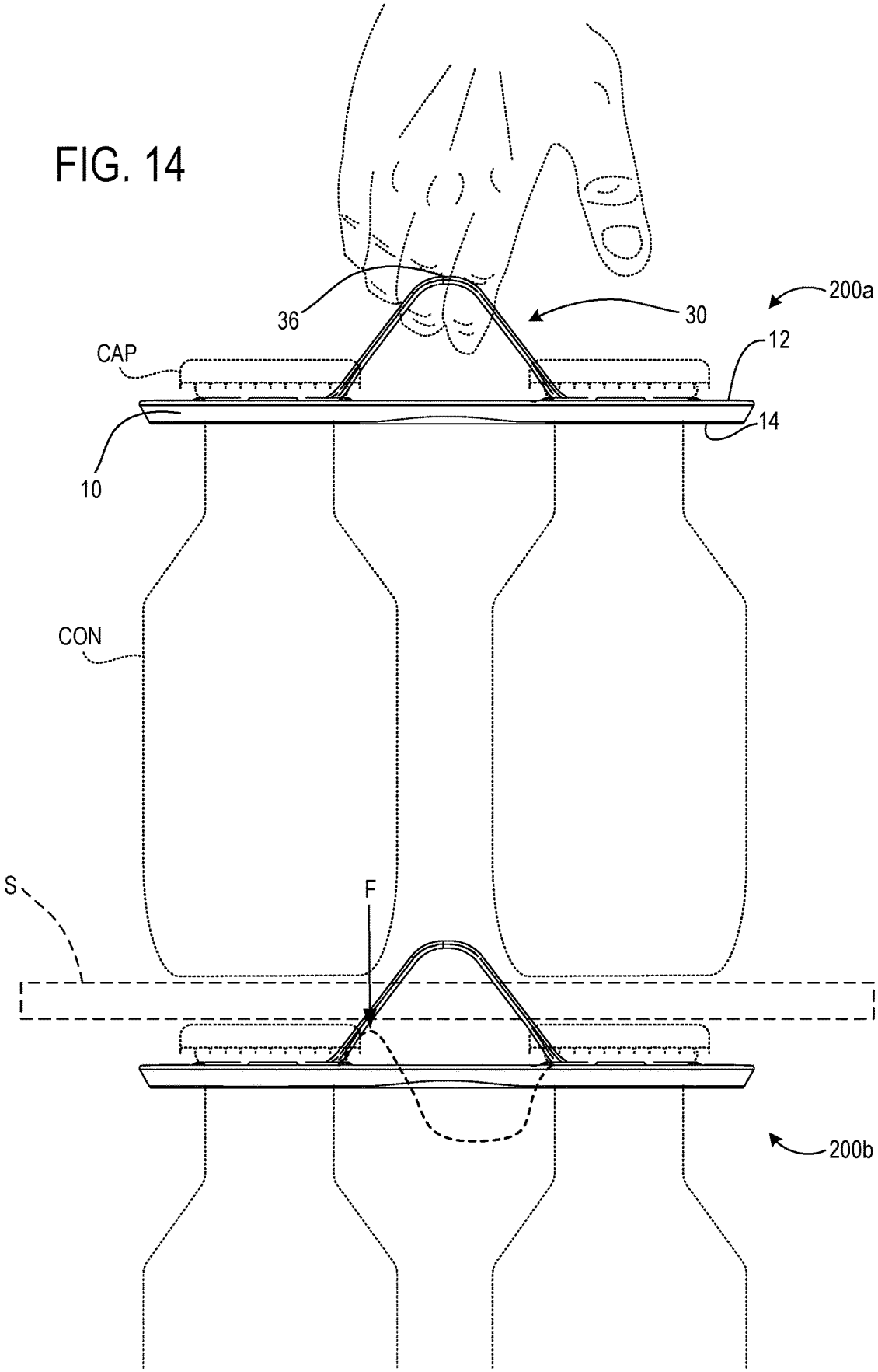
FIG. 14 shows a side view of two container carriers of FIG. 8 in a stacked configuration.

Turning to FIG. 14, a side view of one embodiment of two container carriers 200*a*, 200*b* in a stacked configuration is shown. As described above, some or all of the handle 30 may flex downward below the bottom surface 14 of the body 10 of the container carrier 200 when a downward biasing force F is applied from above. As such a configuration, the handle 30 of the respective lower container carrier 200*b* deflects to a position that is at least partially below the bottom surface 14 of the body 10 of the container carrier 200*b*, as illustrated by the dashed line in FIG. 14 that represents the handle 30 in a deflected position in which the shape of the curve of the loop is concave up.

Figure 11:
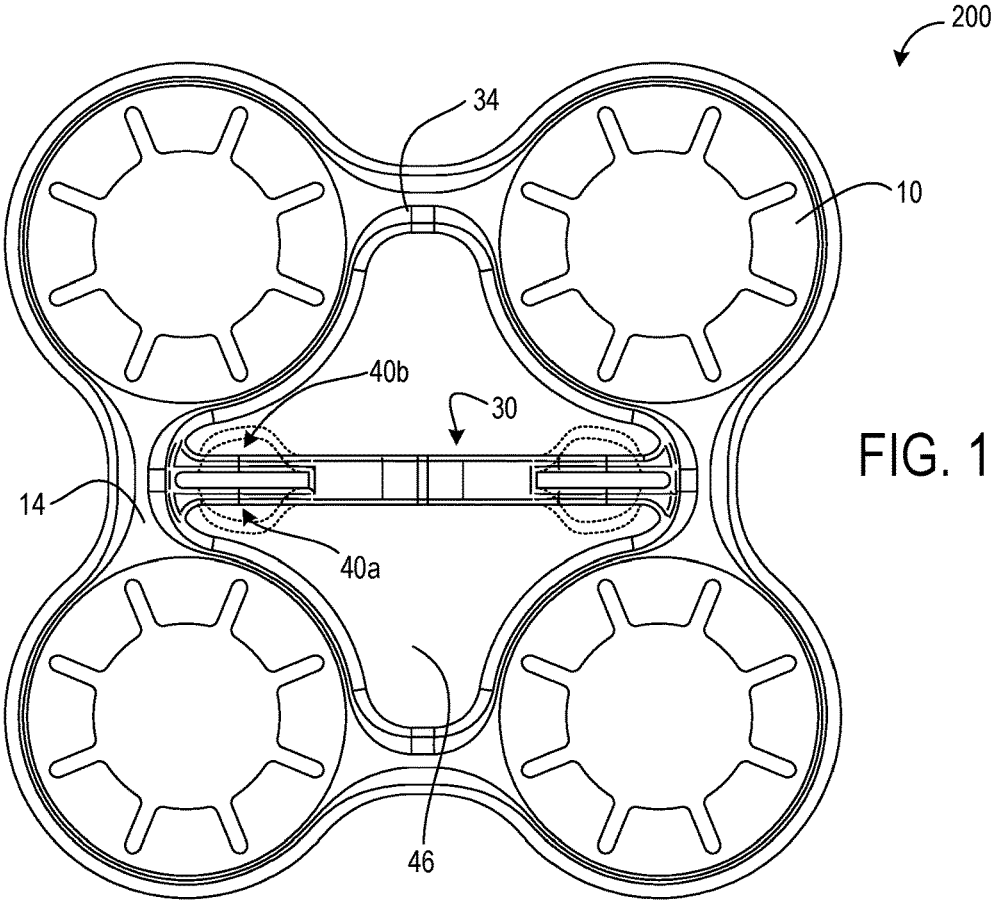
FIG. 11 shows a bottom view of the container carrier of FIG. 8.

Continuing now to FIGS. 10 and 11, top and bottom views of the container carrier 200 are provided. Of note, the second embodiment of the container carrier 200 lacks one or more container-engaging structures 16*a* that are formed with a semi-annular shape. The equidistant arrangement of four annular structures in the second embodiment provides sufficient room in the area of the interior void 46 for the flexion of the handle 30 as it transitions from an upright position to a deflected position.

Figure 12:
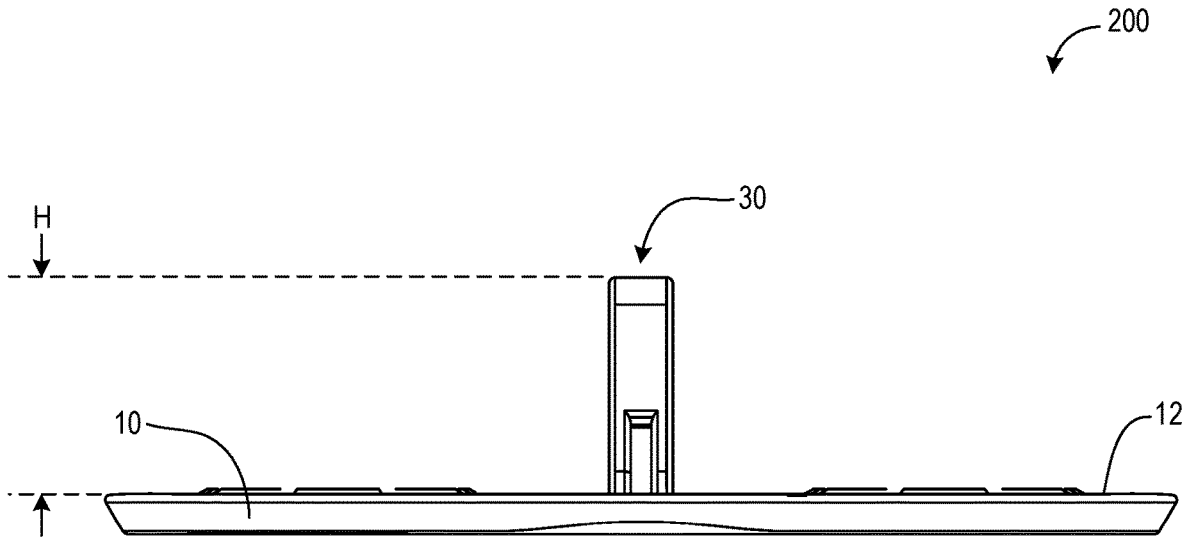
FIG. 12 shows a front view of the container carrier of FIG. 8, wherein the back view is a mirror image thereof.
Figure 13:
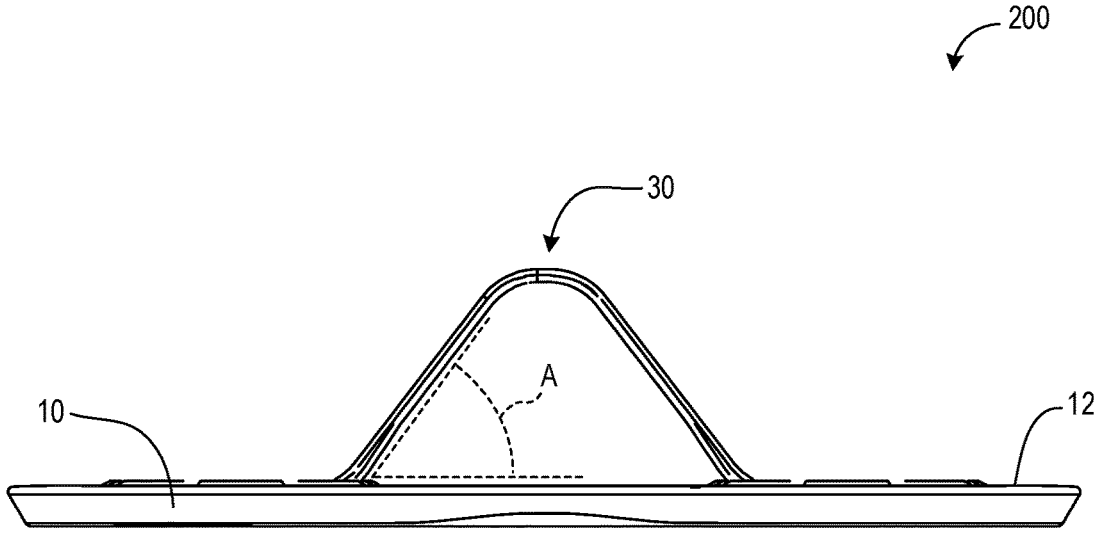
FIG. 13 shows a right view of the container carrier of FIG. 8, wherein the left view is an identical image thereof.

Turning now to FIGS. 12 and 13, front and side views, respectively, of the container carrier 200 are illustrated. As described above, the peak height H of the handle 30 may be in a range of 1 cm to 10 cm from the top surface 12 of the body 10 of the container carrier 200, positioned at a central location with respect to the body 10 of the container carrier 200, and oriented upwardly at a predetermined angle A in a range of 15 degrees to 60 degrees relative to the top surface 12 of the body 10 of the container carrier 200.

In any of the embodiments described herein, the container carrier may be preferentially formed of a flexible plastic. Being both strong and lightweight, plastic is an advantageous material for use in container carriers. It is preferable that the plastic be flexible in nature to accommodate the flexible nature of the handle, as well as the releasable engagement of the containers with the flanges. Specifically, the plastic may be high density polyethylene (HDPE), and it may further be recycled HDPE. It will be appreciated that container carriers formed of flexible plastic have the additional benefit of being recyclable.

The container carriers described above may be used to provide a convenient carrying mechanism for containers of all sorts, but are particularly advantageous due to the manner in which the handle extends beyond the top of the container carrier. In some circumstances, the caps of the containers secured within the container carrier may possess sharp edges that can cut or damage the skin of the user. The container carriers described herein prevent such an undesirable situation by allowing a user to grasp and carry the container carrier without contacting the caps of the containers secured within the container carrier.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A container carrier for securing together and carrying multiple containers, the container carrier comprising:

an integrally molded body including a top surface, a bottom surface, and a plurality of annular structures, wherein each annular structure is connected to at least one adjacent annular structure of the plurality of annular structures by a bridge, wherein each annular structure has a circumferential rib with a plurality of flanges coupled to the circumferential rib, each flange including an inwardly projecting portion, and wherein an inner perimeter of each flange is formed to have an arcuate shape, the inner perimeters of the flanges being collectively configured to define a void; and an integrally formed handle that extends in an upward orientation from the body of the container carrier, wherein a shape of a curve of the handle is concave down in an upright position in an unbiased state, and the shape of the curve of the handle is concave up in a deflected position in a biased state, wherein the handle includes a graspable region and a bifurcated region that bifurcates into a pair of arms, wherein each arm of the pair of arms connects to the body of the container carrier at a connection point and supports the graspable region in the upright position in the unbiased state, and wherein the pair of arms flexes to allow an intersection of the bifurcated region and graspable region to move, thereby accommodating a downward flexion of the graspable region of the handle when a downward biasing force is applied to the handle in the biased state.

2. The container carrier of claim 1, wherein the graspable region spans a peak height of the handle in the unbiased state.

3. The container carrier of claim 1, wherein the graspable region includes a flat expanse on a least a lower surface thereof that is configured to be gripped by the fingers of a user.

4. The container carrier of claim 3, wherein the flat expanse of the graspable region is solid.

5. The container carrier of claim 3, wherein the flat expanse of the graspable region includes one or more perforations.

6. The container carrier of claim 1, wherein the peak height of the handle is in a range of 1 cm to 10 cm from the top surface of the body of the container carrier, and the handle is oriented upwardly at a predetermined angle in a range of 15 degrees to 60 degrees relative to the top surface of the body of the container carrier.

7. The container carrier of claim 1, wherein a first arm of the bifurcated region connects at a first connection point to a first bridge of the body, and a second arm of the bifurcated region connects at a second connection point to a second bridge of the body.

8. The container carrier of claim 2, wherein the peak height of the handle is positioned at a central location with respect to the body of the container carrier.

9. The container carrier of claim 1, wherein each arm of the pair of arms includes a straight region and a curved region.

10. The container carrier of claim 1, wherein the flanges of each annular structure are configured to flex independently during ingress or egress of one of the containers into or out of the corresponding void; and in an unflexed state, the flanges collectively conform to a curvature of a neck of one of the containers to releasably engage the container, the neck being smaller than a lip or a cap of the container.

11. The container carrier of claim 1, wherein each inwardly projecting portion extends inwardly from the circumferential rib, and all of the inwardly projecting portions are oriented upwardly at a predetermined angle from the circumferential rib.

12. The container carrier of claim 1, wherein the bifurcated region is a first bifurcated region that bifurcates into a first pair of arms, the first bifurcated region being coupled to a first side of the graspable region at a first intersection, and the handle further includes a second bifurcated region coupled to a second side of the graspable region at a second intersection positioned opposite the first intersection of the graspable region, wherein the second bifurcated region bifurcates into a second pair of arms, wherein each arm of the second pair of arms connects to the body of the container carrier at a connection point and supports the graspable region in an upright configuration in the unbiased state, and wherein the second pair of arms flexes to allow a second intersection of the bifurcated region and graspable region to move, thereby accommodating a downward flexion of the graspable region of the handle when a downward biasing force is applied to the handle in the biased state.

13. The container carrier of claim 12, wherein flexing of the first and second pairs of arms causes the first and second intersections, respectively positioned at the first and second sides of the graspable region, to move away from each other, thereby increasing a distance between the first and second bifurcated regions to accommodate passage of the graspable region between the first and second bifurcated regions as viewed from above, and through a plane of the body, as viewed from a side.

14. A container carrier for securing together and carrying multiple containers comprising:

an integrally molded body including a top surface, a bottom surface, and a plurality of annular and/or semi-annular structures, wherein each annular and/or semi-annular structure is connected to at least one adjacent annular or semi-annular structure of the plurality of annular and/or semi-annular structures by a bridge, wherein each annular or semi-annular structure has a circumferential rib with a plurality of flanges coupled to the circumferential rib, each flange including an inwardly projecting portion, and wherein an inner perimeter of each flange is formed to have an arcuate shape, the inner perimeters of the flanges being collectively configured to define a void; and an integrally formed handle that extends in an upward orientation from the body of the container carrier;

wherein the handle includes a graspable region and a bifurcated region that bifurcates into a pair of arms, wherein each arm of the pair of arms connects to the body of the container carrier at a connection point and supports the graspable region in an upright configuration in an unbiased state, wherein the pair of arms flexes to allow an intersection of the bifurcated region and graspable region to move, thereby accommodating a downward flexion of the graspable region of the handle when a downward biasing force is applied to the handle in a biased state, wherein a first arm of the bifurcated region connects at a first connection point to a first bridge of the body, and a second arm of the bifurcated region connects at a second connection point to a second bridge of the body, and wherein a shape of a curve of the handle is concave down in an upright position, and the shape of the curve of the handle is concave up in a deflected position.

* * * * *